US007318701B2

(12) United States Patent
Farmer

(10) Patent No.: US 7,318,701 B2
(45) Date of Patent: Jan. 15, 2008

(54) CEILING FAN LIGHTING SYSTEM

(76) Inventor: Clinton S. Farmer, HC 62 Box 3335 South, Pittsburgh, OK (US) 74560

( * ) Notice: Subject to any disclaimer, the term of this patent is extended or adjusted under 35 U.S.C. 154(b) by 141 days.

(21) Appl. No.: 11/280,753

(22) Filed: Nov. 17, 2005

(65) Prior Publication Data

US 2007/0110581 A1 May 17, 2007

(51) Int. Cl.
*F04D 29/34* (2006.01)

(52) U.S. Cl. ..... 416/5; 416/61; 416/224

(58) Field of Classification Search ..... 416/5, 416/61, 224

See application file for complete search history.

(56) References Cited

U.S. PATENT DOCUMENTS 1,747,433 A * 2/1930 Genest ..... 40/441
5,028,206 A 7/1991 Kendregan et al.
5,072,341 A 12/1991 Huang
5,082,422 A 1/1992 Wang
D346,211 S 4/1994 Bucher et al.
5,437,540 A 8/1995 Blocker et al.
6,036,331 A 3/2000 Acquisto
6,146,097 A * 11/2000 Bradt ..... 416/5
6,265,984 B1 * 7/2001 Molinaroli ..... 340/815.4

* cited by examiner

*Primary Examiner*—Igor Kershteyn

(57) ABSTRACT

A ceiling fan lighting system includes a ceiling fan having motor and a plurality of blades operationally coupled to the motor to permit rotation of the blades when the motor is supplied with power. A plurality of mounting assemblies engages at least two of the blades of the fan. A plurality of light emitting members is provided. Each of the light emitters is configured to emit light and each of the mounting assemblies engages one of the light emitters to mount each of the light emitting members to an associated one of the blades.

5 Claims, 3 Drawing Sheets

CEILING FAN LIGHTING SYSTEM

BACKGROUND OF THE INVENTION

1. Field of the Invention

The present invention relates to illuminated blade ceiling fans and more particularly pertains to a new illuminated blade ceiling fan for casting light on the walls of a room and creating an ambience as the light moves along the walls.

2. Description of the Prior Art

The use of illuminated blade ceiling fans is known in the prior art. U.S. Pat. No. 5,437,540 describes a system for illuminating the blades of ceiling fan. Another type of illuminated blade ceiling fan is U.S. Pat. No. 5,028,206 for lighting the room.

While these devices fulfill their respective, particular objectives and requirements, the need remains for a system that includes certain improved features allowing for light to directed at a desired height on the walls of the room and having the lights move along the walls to create a desired ambience.

SUMMARY OF THE INVENTION

The present invention meets the needs presented above by generally comprising a ceiling fan that includes a motor and a plurality of blades operationally coupled to the motor to permit rotation of the blades when the motor is supplied with power. A plurality of mounting assemblies engages at least two of the blades of the fan. A plurality of light emitting members is provided. Each of the light emitters is configured to emit light and each of the mounting assemblies engages one of the light emitters to mount each of the light emitting members to an associated one of the blades.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
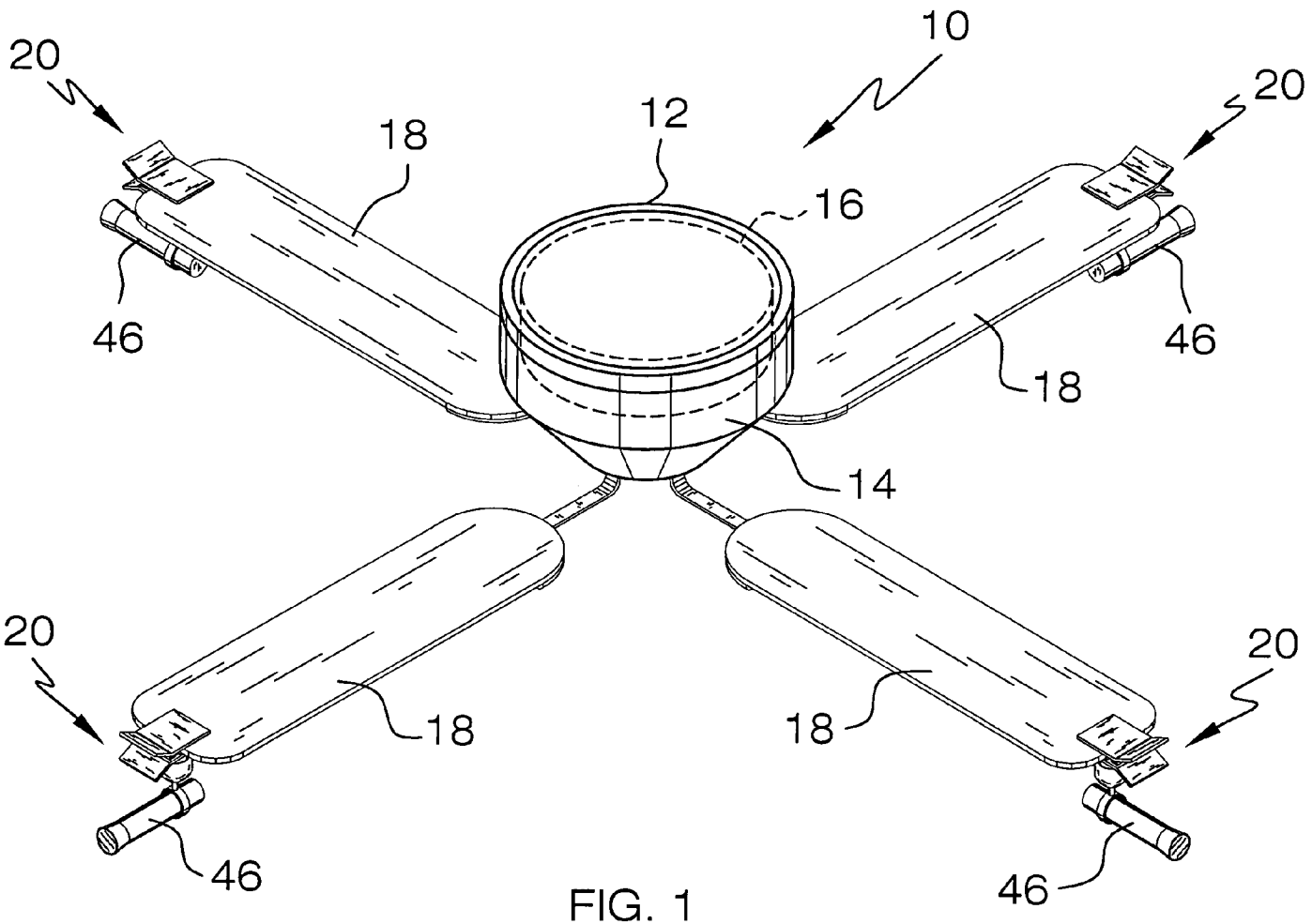
FIG. 1 is a perspective view of a ceiling fan lighting system according to the present invention.

With reference now to the drawings, and in particular to FIGS. 1 through 4 thereof, a new illuminated blade ceiling fan embodying the principles and concepts of the present invention and generally designated by the reference numeral 10 will be described.

As best illustrated in FIGS. 1 through 4, the ceiling fan 12 lighting system 10 generally comprises a generally conventional ceiling fan 12 that is mountable on a support surface, particularly a ceiling. The ceiling fan 12 includes a housing 14 configured to mount to the support surface. A motor 16 of the fan 12 is positioned in the housing 14. A plurality of blades 18 is operationally coupled to the motor 16 to permit rotation of the blades 18 when the motor 16 is supplied with power. The blades 18 are suspended from the motor 16 to position the blades 18 in spaced relationship from the housing 14 and opposite the support surface.

Figure 2:
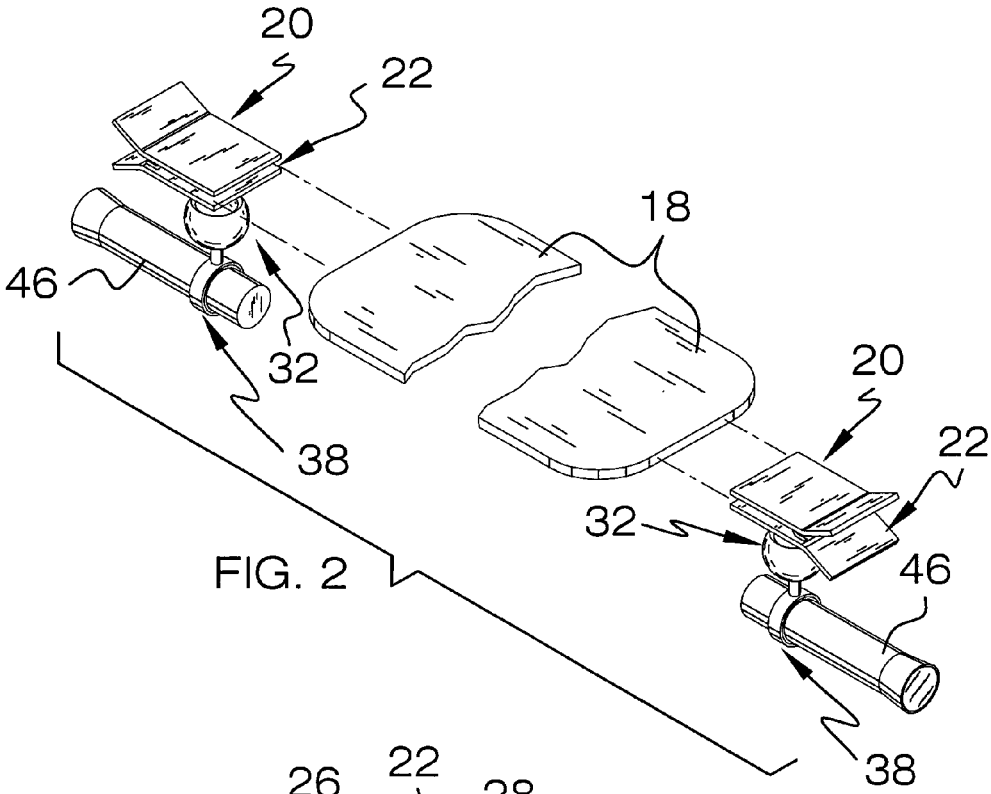
FIG. 2 is an enlarged exploded perspective view of two of the mounting assemblies of the present invention.
Figure 3:
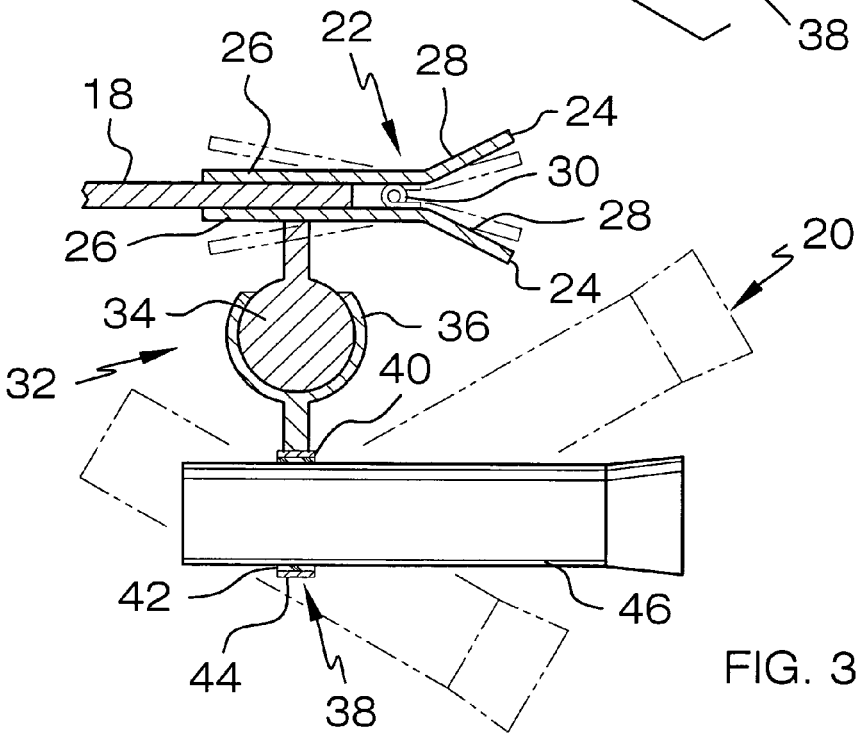
FIG. 3 is a cross-sectional view of one of the blades and one of the mounting assemblies of the present invention.

A plurality of mounting assemblies 20 engages at least two of the blades 18 of the fan 12. To maintain balance of the blades 18 of the fan 12, preferably diametric opposite blades 18 should be used, as shown in FIG. 2, or all fan 12 blades 18 should be used. Each of the mounting assemblies 20 includes a clamp 22 configured to secure the associated one of the mounting assemblies 20 to one of the blades 18 of the fan 12. The clamp 22 of each of the mounting assemblies 20 includes a pair of plates 24 biased together to permit the associated one of the blades 18 to be clamp 22*ed* between the plates 24. Each of the plates 24 includes an engagement portion 26 configured to engage the associated one of the blades 18 and a lever portion 28 positioned at an angle to the engagement portion 26 of an associated one of the plates 24. The lever portion 28 of each of the plates 24 of one of the mounting assemblies 20 is configured to be pressed together by a hand of the user to force the engagement portion 26 of each of the plates 24 of the associated one of the mounting assemblies 20 apart to permit removal of the associated one of the mounting assemblies 20 from one of the blades 18 of the fan 12. The clamp 22 of each of the mounting assemblies 20 includes a biasing member 30 operationally coupled between the plates 24 of the associated one of the mounting assemblies 20 to bias the plates 24 against the associated one of the blades 18 when the associated one of the mounting assemblies 20 engages one of the blades 18.

Figure 4:
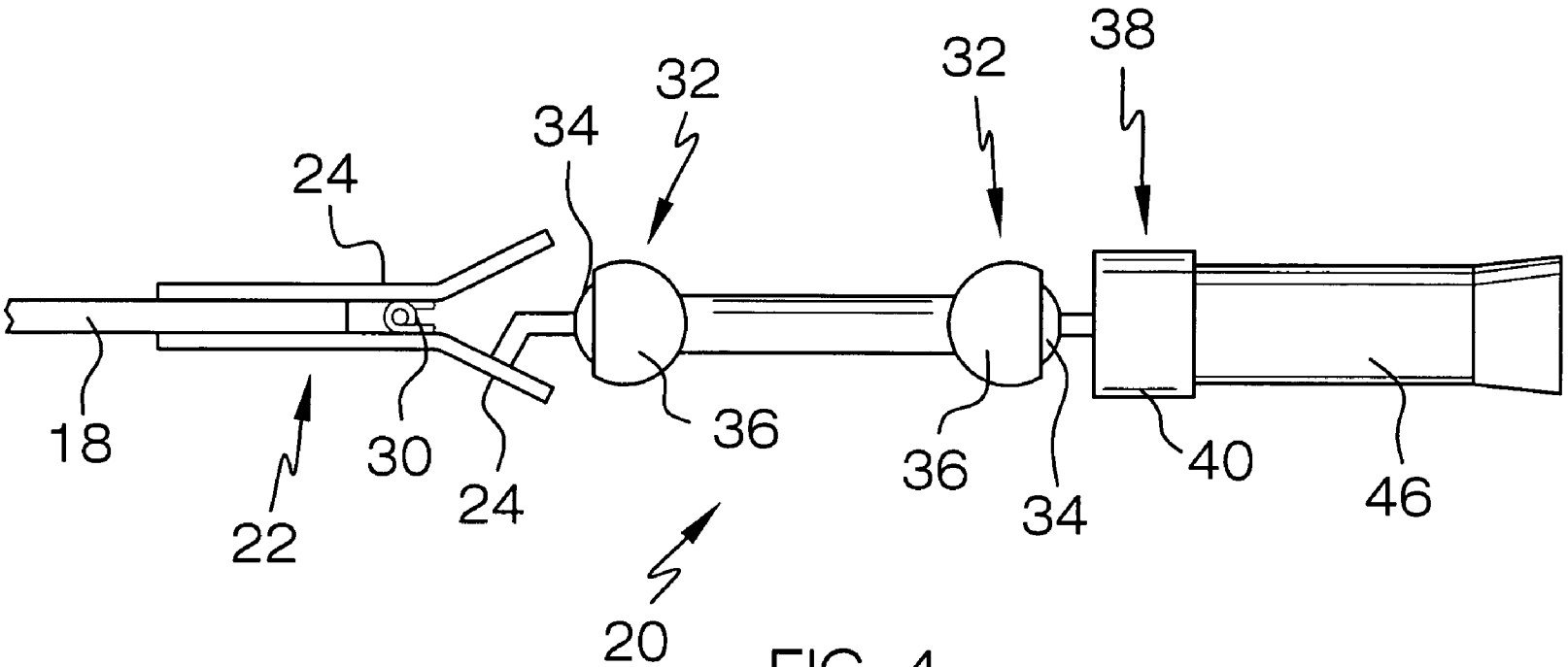
FIG. 4 is a side view of two of an embodiment of the present invention.

Each of the mounting assemblies 20 includes at least one ball joint 32 coupled to one of the plates 24 of the associated one of the mounting assemblies 20. The at least one ball joint 32 of each of the mounting assemblies 20 includes a ball portion 34 coupled to one the plates 24 of the associated one of the mounting assemblies 20 and a socket portion 36 receiving the ball portion 34 to permit pivoting of the socket portion 36 around the ball portion 34. Each of the mounting assemblies 20 includes a receiver 38 coupled to the socket portion 36 of the ball joint 32 of the associated one of the mounting assemblies 20 to permit the receiver 38 to be pivoted around the ball portion 34 of the ball joint 32 of the associated one of the mounting assemblies 20. The receiver 38 of each of the mounting assemblies 20 includes a ring portion 40 coupled to the socket portion 36 of the ball joint 32 of the associated one of the mounting assemblies 20 and a traction portion 42 coupled to an interior surface 44 of the ring portion 40 of the receiver 38 of the associated one of the mounting assemblies 20. The traction portion 42 is preferably comprised of an elastomeric material. In an embodiment, as shown in FIG. 4, a plurality of ball joints 32 coupled together may be positioned between the clamp 22 and receiver 38 to allow an even greater selection of positions for the receiver 38.

A plurality of light emitting members 46, such as flashlights, is configured to emit light on walls of a room when the blades 18 of the fan 12 are rotated. Each of the receivers 38 engages one of the light emitters 46 to mount each of the light emitting members 46 to an associated one of the blades 18 of the fan 12. Each of the light emitting members 46 is inserted into the ring portion 40 of the receiver 38 of the associated one of the mounting assemblies 20 to permit pivoting of the light emitting members 46 with respect to the blade to direct the light emitting members 46 at a desired height on the walls of the room. The traction portion 42 of the receiver 38 of each of the mounting assemblies 20 frictionally engages the associated one of the light emitting members 46 to inhibit slipping of the associated one of the light emitting members 46 from the receiver 38 of the associated one of the mounting assemblies 20 when the blades 18 of the fan 12 are rotated.

In use, the user engages the clamp 22 of each of the mounting assemblies 20 to the secure the mounting assemblies 20 to the blades 18 of the fan 12. Each of the light emitting members 46 is inserted into the receiver 38 of one of the mounting assemblies 20. Each of the light emitting members 46 are then adjusted to direct light at desired height on the wall of a room in which the fan 12 is mounted. Power is provided to the motor 16 of the fan 12 and the blades 18 are rotated which rotates the light emitting members 46 and causing the light emitted by the light emitting members 46 to move along the walls of the room.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A ceiling fan lighting system comprising:

a ceiling fan including a motor and a plurality of blades being operationally coupled to said motor to permit rotation of said blades when said motor is supplied with power;

a plurality of mounting assemblies engaging at least two of said blades of said fan, each of said mounting assemblies includes;

a clamp configured to secure the associated one of said mounting assemblies to one of said blades of said fan;

at least one ball joint being coupled to said clamp, said at least one ball joint including a ball portion coupled to an associated one of said plates and a socket portion receiving said ball portion wherein said socket portion is pivotable around said ball portion;

a receiver coupled to said socket portion; and a plurality of light emitting members, each of said light emitting members being configured to emit light, each of said mounting assemblies engaging one of said light emitting members to mount each of said light emitting members to an associated one of said blades, said receiver of each of said mounting assemblies being configured to engage one of said light emitting members.

2. The system according to claim 1, wherein each of said clamps includes a pair of plates biased together to permit the associated one of said blades to be clamped between said plates.

3. The system according to claim 2, wherein each of said plates includes an engagement portion configured to engage the associated one of said blades and a lever portion positioned at an angle to said engagement portion of an associated one of said plates, a biasing member being operationally coupled between said plates to bias said plates against the associated one of said blades when said clamp engages one of said blades.

4. The system according to claim 1, wherein said receiver includes a ring portion coupled to said socket portion and a traction portion coupled to an interior surface of said ring portion, each of said mounting assemblies engaging one of said light emitting members to mount each of said light emitting members to an associated one of said blades of said fan, each of said light emitting members being inserted into an associated one of said receivers of the associated one of said mounting assemblies to permit selective pivoting of said light emitting members with respect to said blade, said traction portions frictionally engaging an associated one of said light emitting members.

5. A ceiling fan lighting system comprising:

a ceiling fan including a motor and a plurality of blades being operationally coupled to said motor to permit rotation of said blades when said motor is supplied with power;

a plurality of mounting assemblies engaging at least two of said blades of said fan, each of said mounting assemblies including;

a clamp configured to secure the associated one of said mounting assemblies to one of said blades of said fan, said clamp including a pair of plates biased together to permit the associated one of said blades to be clamped between said plates, each of said plates including an engagement portion configured to engage the associated one of said blades and a lever portion positioned at an angle to said engagement portion of an associated one of said plates, a biasing member being operationally coupled between said plates to bias said plates against the associated one of said blades when said clamp engages one of said blades;

at least one ball joint being coupled to one of said plates, said at least one ball joint including a ball portion coupled to an associated one of said plates and a socket portion receiving said ball portion wherein said socket portion is pivotable around said ball portion;

a receiver coupled to said socket portion, said receiver including a ring portion coupled to said socket portion and a traction portion coupled to an interior surface of said ring portion;

a plurality of light emitting members, each of said light emitting members being configured to emit light, each of said mounting assemblies engaging one of said light emitting members to mount each of said light emitting members to an associated one of said blades of said fan, each of said light emitting members being inserted into an associated ones of said receivers of the associated one of said mounting assemblies to permit selective pivoting of said light emitting members with respect to said blade, said traction portions frictionally engaging an associated one of said light emitting members.

* * * * *